United States Patent [19]

Watanabe et al.

[11] Patent Number: 4,643,929

[45] Date of Patent: Feb. 17, 1987

[54] STEEL MATERIALS FOR USE WITH PRESTRESSED CONCRETE

[75] Inventors: Kanji Watanabe; Mikio Mizoe; Eiji Inoo, all of Hyogo, Japan

[73] Assignee: Sumitomo Electric Industries, Ltd., Osaka, Japan

[21] Appl. No.: 681,773

[22] Filed: Dec. 14, 1984

[30] Foreign Application Priority Data

Dec. 16, 1983 [JP] Japan ..... 58-194474[U]

[51] Int. Cl.[4] ..... B32B 13/02; E04C 3/10; E04C 3/34; E04C 5/08

[52] U.S. Cl. ..... 428/36; 52/230; 52/722; 52/735; 428/312.4; 428/332; 428/375; 428/379; 428/383; 428/461

[58] Field of Search ..... 428/379, 375, 335, 336, 428/383, 461, 36; 156/84, 85, 86; 57/217, 221, 223; 174/DIG. 8; 264/228; 52/722, 735, 230

[56] References Cited

U.S. PATENT DOCUMENTS

| | | | |
|---|---|---|---|
| 2,821,155 | 1/1958 | Seckel | 156/86 |
| 3,404,526 | 10/1968 | Thomas | 57/217 |
| 3,579,931 | 5/1971 | Lang | 264/228 |
| 3,922,437 | 11/1975 | Kitta et al. | 57/223 |
| 4,133,935 | 1/1979 | Dawson | 428/379 |
| 4,181,775 | 1/1980 | Corke | 174/DIG. 8 |
| 4,521,470 | 6/1985 | Overbergh et al. | 428/36 |

FOREIGN PATENT DOCUMENTS

| | | | |
|---|---|---|---|
| 0098488 | 6/1983 | Japan | 57/221 |

*Primary Examiner*—Paul J. Thibodeau

*Attorney, Agent, or Firm*—Sughrue, Mion, Zinn, Macpeak & Seas

[57] ABSTRACT

Prestressing steel materials are disclosed for use with concrete that is prestressed by posttensioning, said steel material being unbonded from the concrete. The steel materials are composed of steel members sheathed with a heat-shrinkable synthetic resin tube. Preferably, the wall thickness of the resin tube is at least 300 microns. In the case of a steel strand composed of a plurality of twisted steel wires, spiral grooves of the strand are filled with a resin and then the strand and resin are sheathed with a heat-shrinkable synthetic resin tube.

6 Claims, 4 Drawing Figures

STEEL MATERIALS FOR USE WITH PRESTRESSED CONCRETE

BACKGROUND OF THE INVENTION

The present invention relates to prestressing steel materials for use with concrete that is prestressed by posttensioning. In particular, the present invention relates to a prestressing steel materials subjected to the posttensioning to be in an unbonded state in which the steel material is not bonded to the concrete.

Concrete has a relatively low tensile strength. In order to overcome this disadvantage, prestressed concrete has been developed. By means of high strength steel wires, bars or strands, a concrete member is precompressed. When the structure receives a load, the compression is relieved on that portion which would normally be in tension.

There are two general methods of prestressing, namely, pretensioning and posttensioning. The present invention relates to prestressing steel materials for use with concrete of the type that is prestressed by posttensioning.

Structural designs used to prevent direct contact between prestressing steel materials and the surrounding prestressed concrete are illustrated in FIGS. 1 and 2. The design shown in FIG. 1 can be used whether the steel material is in the form of a wire, bar or strand. A steel member 1 having a grease coating 2 is sheathed with a PE (polyethylene) tube 3. When the steel member 1 with the PE tube 3 is placed within a concrete section 4, the lubricating effect of the intermediate grease coating 2 reduces the coefficient of friction between the steel member and concrete to as low as between 0.002 and 0.005 $m^{-1}$. Because of this low coefficient of friction, the design in FIG. 1 provides great ease in posttensioning a long steel cable in concrete. However, if the steel material is of short length, the need for preventing grease leakage from either end of the PE tube presents great difficulty in fabricating and handling the steel material. Furthermore, steel members having screws or heads at both ends are difficult to produce in a continuous fashion.

The steel member 1 shown in FIG. 2, which is encapsulated in asphalt 5 and embedded in a concrete section 4, has a slightly greater coefficient of friction than the structure shown in FIG. 1. This design is extensively used with relatively short prestressing steel materials since it is simple in construction, is leak-free, and provides ease in unbonding the steel material from the concrete, even if the steel member has screws or heads at end portions.

One problem with the design in FIG. 2 is that the presence of the asphalt (or, alternatively, a paint) may adversely affect the working environment due to the inclusion therein of a volatile organic solvent. Moreover, the floor may be fouled by the splashing of the asphalt or paint. As another problem, great difficulty is involved in handling the coated steel material during drying or positioning within a framework, and separation of the asphalt coating can easily occur unless utmost care is taken in ensuring the desired coating thickness.

SUMMARY OF THE INVENTION

Accordingly, a primary object of the present invention is to provide a prestressing steel material for use with prestressed concrete that is free from the problems associated with the prior art techniques. In particular, the present invention provides a prestressing steel material subject to the posttensioning to be in an unbonded state in which the steel material is not bonded to the concrete.

This and other objects of the present invention are achieved by sheathing a prestressing steel member for prestressed concrete with a heat-shrinkable synthetic resin tube.

DESCRIPTION OF THE PREFERRED EMBODIMENTS

According to the present invention, the steel material need not be bonded to the heat-shrinkable synthetic resin tube with an adhesive material. If improved rust-preventing and anti-corrosion effects are desired, the steel member and the resin tube may be bonded by an adhesive member. It the steel member is a bar, a heat-fusible synthetic resin adhesive is coated or placed on the inner surface of the resin tube or the outer surface of the steel bar, and, after the resin tube is slipped over the steel bar, heat is applied to cause the resin tube to shrink as the resin adhesive melts to provide firm adhesion between the steel bar and the resin tube. It has been found by the present inventors that this method is the simplest and best way to ensure firm bonding between the steel bar and the synthetic resin tube. Thus, in this invention, the steel member is not movable relative to the heat-shrinkable synthetic resin tube.

Figure 1:
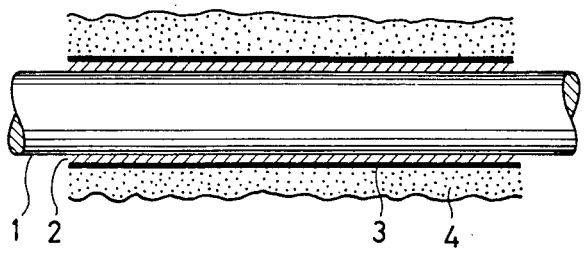
FIGS. 1 and 2 shown schematically conventional designs of prestressing steel materials for concrete prestressed by posttensioning.
Figure 2:
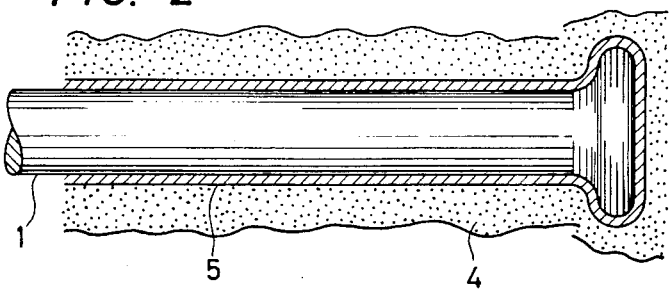
Figure 3:
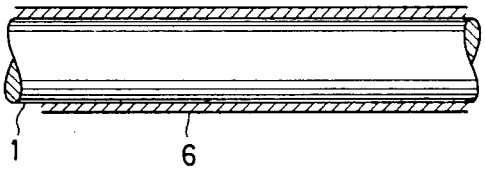
FIG. 3 is a schematic presentation of a prestressing steel material of the present invention for use with prestressed concrete.

The prestressing steel material for prestressed concrete according to the present invention is illustrated in FIG. 3, wherein reference numeral 1 refers to the steel member and 6 represents the heat-shrinkable synthetic resin tube coated on the surface of the steel member. In one preferred embodiment, the steel member 1 is inserted into a prefabricated heat-shrinkable synthetic resin tube, which is then heated by hot air, steam or with an IR (infrared) heater to shrink and tightly fit it onto the surface of the steel member.

The wall thickness of the heat-shrinkable synthetic resin tube must be at least 300 microns in order to isolate the steel member 1 and the surrounding concrete layer sufficiently to provide good slippage between the two components. Thus, the prestressing steel material is free to move relative to the concrete. The wall thickness to of the synthetic resin tube after heat shrinking can be approximated by the following equation:

$$t=(\tfrac{1}{2})(((D+2t_1)^2-D_1^2+D_0^2)^{\frac{1}{2}}-D_0),$$

where

- t: wall thickness (mm) after heat shrinking
- $D_0$: outside diameter (mm) of steel bar
- $D_1$: inside diameter (mm) of the tube before heat shrinking
- $t_1$: wall thickness (mm) before heat shrinking.

If a steel bar of $D_0=17$ mm is inserted into a resin tube having an inside diameter of 20 mm and a wall thickness of 0.3 mm and if the tube is heat-shrunk to provide intimate contact with the steel bar, the tube around the steel bar will have a wall thickness as large as about 0.35 mm. A heat-shrinkable polyolefin tube has a heat shrinkage of about 35%. Thus, the inside diameter of the tube can be selected from the range of 1.1 to 1.5 times the outside diameter of the steel bar. This fairly large inside diameter of the polyolefin tube permits considerable ease in inserting the steel bar through the tube. Furthermore, by properly selecting the inside diameter and wall thickness of the heat-shrinkable synthetic resin tube to be used with a steel bar having a specific outside diameter, the desired wall thickness of the tube will be provided around the steel bar after heat shrinkage.

Samples of prestressing steel materials for use with prestressed concrete that included steel members coated with a heat-shrinkable synthetic resin tube were fabricated and subjected to various tests to determine their properties. The results are shown in Tables 1 to 3.

TABLE 1

| Basic properties of Samples | | |
|---|---|---|
| Dimensions of steel member: | Bar having an outside diameter of 17 mm and a length of 2,830 mm | |
| Resin tube: | High-density polyethylene tube that was rendered heat-shrinkable by cross-linking under exposure to electron beam | |
| Density: | 0.95 g/cm$^2$ | |
| Tensile strength: | 1.0 kg/mm$^2$ | |
| Elongation: | 300% | |
| Heat resistance: | 350° C. (1 min.) | |
| Saltwater resistance: | | OK |
| Alkali resistance: | | OK |
| Acid resistance: | (10% HCl) | OK |
| | (10% $H_2SO_4$) | OK |

TABLE 2

| | Unbonding (Frictional) Properties | | | | |
|---|---|---|---|---|---|
| | Load (Kgf) | | | Frictional | |
| Sample No. | Tensioned side (Pi) | Fixed Side (Po) | Frictional loss (Kgf) | coefficient $\lambda$ (m$^{-1}$) | Remarks |
| 1 | 19.490 | 19.110 | 380 | 0.00817 | Length of |
| 2 | 19.540 | 19.135 | 405 | 0.00869 | concrete |
| 3 | 19.530 | 19.190 | 340 | 0.00728 | section: |
| 4 | 19.480 | 19.105 | 375 | 0.00806 | l = 2,435 mm |
| 5 | 19.510 | 19.015 | 495 | 0.01069 | Sample |
| 6 | 19.500 | 19.185 | 315 | 0.00674 | tempera- |
| 7 | 19.520 | 19.065 | 455 | 0.00980 | ture: |
| 8 | 19.500 | 18.970 | 530 | 0.01147 | T = 25° C. |
| 9 | 19.510 | 19.080 | 430 | 0.00926 | Frictional |
| 10 | 19.470 | 19.110 | 360 | 0.00774 | coeffi- |
| | | | | | cient: |

$$\lambda = \left(\frac{Pi}{Po} - 1\right) \cdot \frac{1}{l}$$

TABLE 3

| | Rust-preventing Properties | | |
|---|---|---|---|
| | Test | Conditions | Results |
| 1. | Continuous saltwater spray test (2,000 hrs) | JIS Z 2371 (5% aq. NaCl, 35° C.) | No rust or blister formed on the sample surface. No rust on the internal steel bar. |
| 2. | Saltwater immerion test (2,000 hrs) | Immersed in 3% aq. NaCl at 25° C. | No rust or blister formed on the sample surface. No rust on the internal steel bar. |
| 3. | Alkali resistance test (2,000 hrs) | Immersed in 3% NaCl at 25° C. adjusted to pH 11 with KOH | No rust or blister formed on the sample surface. No rust on the internal steel bar. |

Figure 4:
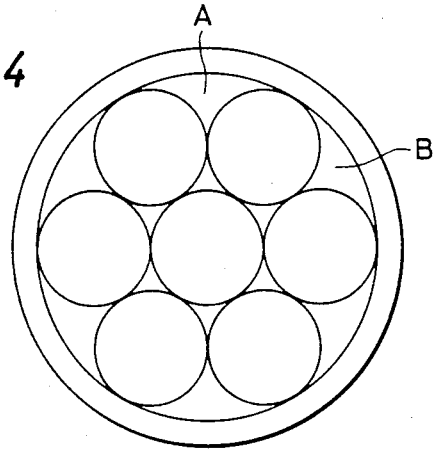
FIG. 4 shows a cross section of a prestressing steel strand sheathed with a resin tube according to the present invention.

The present invention is also applicable to a prestressing steel strand composed of a plurality of twisted steel wires as shown in cross section in FIG. 4. The resulting steel strand has spiral grooves as indicated by A and B in FIG. 4. Not only do these spiral grooves render the posttensioning of the strand difficult, but also they increase the frictional resistance on the stressed concrete. In order to avoid these problems, the grooves are filled with a resin. This filling with a resin may be accomplished by extrusion or other suitable techniques. Subsequently, the thus-treated steel strand is inserted through the heat-shrinkable synthetic resin tube described above and the tube is given the same heat treatment as above to provide intimate contact between the steel strand and the resin tube.

According to the present invention, a prestressing steel material for use with prestressed concrete that has a resin coating with highly precise dimensions can be easily manufactured. The steel material is easy to handle during transport and installation. The steel material has such good slip with respect to the concrete that posttensioning of the steel material can be smoothly effected so as to introduce the desired prestress into the concrete.

We claim:

1. An elongated prestressing steel material embedded in prestressed concrete, wherein said prestressing steel material comprises a steel member and a heat-shrinkable synthetic resin tube surrounding the outer surfaces of said steel member, and in which the prestressing steel material is subjected to posttensioning in an unbounded state wherein the prestressing steel material is not bonded to and is free to move relative to the concrete, and wherein the steel member is bonded to and is not movable relative to the heat-shrinkable synthetic resin tube.

2. A prestressing steel material embedded in prestressed concrete, wherein said prestressing steel material comprises: a steel strand comprising a plurality of steel wires twisted together, said steel strand having spiral grooves; a resin filling said grooves; and a heat-shrinkable synthetic resin tube covering said strand and said resin and heat-shrunk around said strand to provide intimate contact between said strand and said resin tube and further comprising an adhesive material provided between the steel member and the heat-shrinkable synthetic resin tube, wherein upon application of heat, the tube shrinks as the adhesive meets to adhere the steel member and the resin tube and wherein the prestressing steel material is free to move relative to the concrete and the steel strand is not movable relative to the heat-shrinkable synthetic resin tube.

3. An elongated prestressing steel material embedded in prestressed concrete, wherein said prestressing steel material comprises: a steel member, a heat-shrinkable synthetic resin tube surrounding the outer surfaces of said steel member, and an adhesive material provided between the steel member and the heat-shrinkable synthetic resin tube, wherein upon application of heat, the tube shrinks as the adhesive melts to adhere the steel member and the resin tube and wherein the prestressing steel material is in an unbonded state and is free to move with respect to the concrete and the steel member is not movable relative to the heat-shrinkable synthetic resin tube.

4. The steel material of claim 3, wherein a wall thickness of said resin tube is at least 300 microns.

5. The steel material of claim 3, wherein said resin material is a polyolefin.

6. The steel material of claim 3, wherein said resin is a high-density polyethylene.

* * * * *